US007067036B2

(12) United States Patent
Beckstrom

(10) Patent No.: US 7,067,036 B2
(45) Date of Patent: Jun. 27, 2006

(54) ACTIVE MOISTENING SYSTEM FOR MAILING MACHINE

(75) Inventor: David W. Beckstrom, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/670,866

(22) Filed: Sep. 25, 2003

(65) Prior Publication Data

US 2005/0067108 A1 Mar. 31, 2005

(51) Int. Cl.

| | |
|---|---|
| ***B43M 5/00*** | (2006.01) |
| ***B43M 5/04*** | (2006.01) |
| ***B05C 1/02*** | (2006.01) |
| ***B05C 11/04*** | (2006.01) |

(52) U.S. Cl. ..... 156/441.5; 156/390; 156/442.1; 156/442.2; 118/258; 118/263; 118/264

(58) Field of Classification Search ..... 156/441.5, 156/442.2, 442.4, 390, 578; 118/200, 216, 118/256, 258, 260, 263, 264, 268
See application file for complete search history.

(56) References Cited

U.S. PATENT DOCUMENTS

| | | | | |
|---|---|---|---|---|
| 733,392 | A | 7/1903 | Henderson, Jr. | |
| 2,015,507 | A | 9/1935 | Arnold et al. | |
| 3,080,848 | A * | 3/1963 | Grubelic | 118/249 |
| 4,773,962 | A | 9/1988 | Garrigue et al. | |
| 5,006,194 | A * | 4/1991 | Schmaling | 156/442.1 |
| 5,007,371 | A * | 4/1991 | O'Dea et al. | 118/680 |
| 5,569,327 | A | 10/1996 | Paradis et al. | |
| 5,622,560 | A * | 4/1997 | Haroutel et al. | 118/216 |
| 5,665,198 | A | 9/1997 | Bieber et al. | |
| 5,674,348 | A | 10/1997 | DeFiguerido | |
| 5,746,881 | A | 5/1998 | Jenkins et al. | |
| 5,807,463 | A | 9/1998 | Boughton | |
| 5,840,123 | A | 11/1998 | Holbrook | |
| 6,254,679 | B1 * | 7/2001 | Sancenot | 118/401 |
| 6,361,603 | B1 | 3/2002 | Salomon | |

* cited by examiner

*Primary Examiner*—Sue Purvis
(74) *Attorney, Agent, or Firm*—Brian A. Lemm; Angelo N. Chaclas

(57) ABSTRACT

A device for moistening an envelope flap includes a reservoir for holding a moistening fluid and an applicator mounted above the reservoir for applying the moistening fluid to the envelope flap. The moistening device also includes a fluid transfer member that is mounted for rotation about a horizontal axis to transfer moistening fluid from the reservoir to the applicator while the transfer member rotates.

11 Claims, 9 Drawing Sheets

ACTIVE MOISTENING SYSTEM FOR MAILING MACHINE

BACKGROUND

This invention relates generally to mailing systems, and more particularly to a moistener system for moistening an envelope flap of an envelope being processed by a mailing machine.

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

In the moistening/sealing module, a moistening device includes an apparatus for moistening the glue line on flaps of envelopes in preparation for sealing the envelopes in either a mailing machine or an inserter, and may also include a mechanism for moistening a tape. Moistening devices generally fall into two categories: contact and non-contact moistening systems. Contact moistening systems generally deposit a moistening fluid, such as, for example, water or water with a biocide, onto the glue line on a flap of an envelope by contacting the glue line with a wetted applicator. Non-contact systems generally spray the moistening fluid onto the envelope flap.

In contact systems, the wetted applicator typically consists of a contact media such as a brush, foam or felt. The applicator is, at least part of the time, in contact with a wick. The wick is generally a woven material, such as, for example, felt, or can also be a foam material. At least a portion of the wick is located in a reservoir containing the moistening fluid. The moistening fluid is transferred from the wick to the applicator by physical contact pressure between the wick and applicator, thereby wetting the applicator. An envelope flap is guided between the wick and the applicator, such that the applicator contacts the glue line on the flap of the envelope, thereby transferring the moistening fluid to the flap to activate the glue. The flap is then closed and sealed, such as, for example, by passing the closed envelope through a nip of a sealer roller to compress the envelope and flap together, and the envelope is then passed to the next module for continued processing.

There are problems, however, with conventional contact moistening systems. For example, in conventional contact moistening systems, it is difficult to accurately control the quantity of moistening fluid being transferred from the applicator to the envelope flap. If not enough moistening fluid is applied ("under-wetting"), the envelope flap will not properly seal to the envelope body. If too much moistening fluid is applied ("over-wetting"), the excess moistening fluid can cause damage to the envelope and/or its contents. Excessive moistening can also negatively impact any printing performed on the envelope, such as, for example, a postage indicium. For example, if the printing is being done by an ink-jet printer, an excessive amount of moisture will cause the ink to run, thereby possibly rendering any printed information illegible.

There are a number of factors which may cause variations in the degree of wetting of the moistening system applicator, and thus cause variations in the amount of moistening fluid applied to the envelope flap. Among these factors are: the number and/or rate of transport and/or size of envelopes processed by the moistening system; the level of moistening fluid in the reservoir; and environmental factors such as temperature, humidity, and/or altitude. Furthermore, in some cases where a high volume of mail is being processed in a limited time, the amount of moistening fluid that the wick can transfer to the applicator in a given period of time is insufficient to keep the applicator adequately moistened in view of the amount of moistening fluid being removed from the applicator by contact with envelope flaps.

Thus, there exists a need for a contact moistening system in which a greater quantity of moistening fluid can be transferred to the applicator within a given period of time and/or the amount of moistening fluid transferred to the applicator can be controlled to adapt to varying mail processing requirements and/or environmental conditions.

SUMMARY

Accordingly, an improved envelope flap moistening mechanism for a mailing machine is provided. An improved device for moistening an envelope flap includes a reservoir for holding a moistening fluid, an applicator mounted above the reservoir for applying the moistening fluid to the envelope flap, and a fluid transfer member that is mounted for rotation about a horizontal axis. The fluid transfer member is for transferring fluid from the reservoir to the applicator while the transfer member rotates.

The fluid transfer member may include a plurality of pairs of opposed substantially vertical surfaces. The surfaces of each pair of surfaces are separated by a distance that is sufficiently small to allow moistening fluid to be held between the surfaces by surface tension of the fluid to raise the moistening fluid above a surface of the fluid in the reservoir as the transfer member is rotated. At least some of the surfaces of the pairs of opposed surfaces may be substantially annular.

The fluid transfer member may include a substantially cylindrical hub portion and a plurality of generally annular fins extending radially outwardly from the hub portion. At least some of the fins may each terminate in a knife edge oriented so as to point away from the hub portion of the fluid transfer member. The plurality of fins may include a first plurality of fins having a first diameter and terminated in a knife edge and a second plurality of fins interspersed with the fins of the first plurality of fins and having a second diameter that is less than the first diameter.

The flap moistening device may further include a brush mounted in the reservoir and positioned to be combed by the fins of the fluid transfer member as the fluid transfer member rotates.

The applicator may include a brush (different from the brush mounted in the reservoir) and the applicator brush may be mounted so as to pivot between an upper position in which the envelope flap is interposed between the applicator brush and the fluid transfer member and a lower position in which the applicator brush is combed by the fins of the fluid transfer member.

The flap moistening device may further include a drive mechanism coupled to the fluid transfer member for rotationally driving the fluid transfer member, and a control mechanism operatively connected to the drive mechanism for selecting a rotational rate at which the drive mechanism drives the fluid transfer member. The control mechanism may select the rotational rate at which the drive mechanism drives the fluid transfer member based at least in part on at least one of (a) a rate at which envelopes are transported past the applicator, and (b) a size of at least one envelope transported or to be transported past the applicator.

In addition, or alternatively, the flap moistening device may include a sensing mechanism that is operatively connected to the control mechanism and that senses at least one environmental condition, and the control mechanism may select the rotational rate at which the drive mechanism rotationally drives the fluid transfer member based at least in part on a signal output from the sensing mechanism. The term "environmental condition", as used herein and in the appended claims, should be understood to include at least one of the ambient temperature for the flap moistening device, the ambient humidity, the ambient air pressure and the altitude at which the flap moistening device is located.

In one or more other embodiments, the flap moistening device may additionally or alternatively include another sensing mechanism, also operatively connected to the control mechanism, that detects a length of an envelope transported past the applicator, and the control mechanism may select the rotational rate at which the drive mechanism rotationally drives the fluid transfer member based at least in part on a signal output from the envelope length sensing mechanism.

The envelope flap moistening device may also include a mechanism for defining an envelope transport path along which envelopes are transported, with the applicator being positioned adjacent the envelope transport path.

In another aspect of the invention, a method for moistening an envelope flap includes rotating a fluid transfer member about a horizontal axis to transfer moistening fluid to an applicator, and contacting the applicator with the envelope flap to transfer the moistening fluid from the applicator to the flap.

The method may further include selecting a rotational rate of the fluid transfer member from among a plurality of rotational rates. In addition, at least one environmental condition may be sensed, and the selecting of the rotational rate may be based at least in part on a result of the sensing of the environmental condition.

The applicator may include a brush, and the method may further include pivoting the brush between an upper position in which the envelope flap is interposed between the brush and the fluid transfer member and a lower position in which the fluid transfer member combs the brush.

In still another aspect of the invention, a device for moistening an envelope flap includes a transport mechanism for transporting an envelope along an envelope feed path, a reservoir positioned below the envelope feed path and holding a moistening fluid, and a mechanism for replenishing the moistening fluid in the reservoir to maintain a substantially constant level of the moistening fluid in the reservoir. The flap moistening device according to this aspect of the invention further includes a first brush pivotally mounted adjacent the envelope feed path for transferring moistening fluid to a flap of an envelope transported along the envelope feed path, and a fluid transfer member that includes a substantially cylindrical hub portion and a plurality of generally annular fins extending radially outwardly from the hub portion of the fluid transfer member. The plurality of fins of the fluid transfer member include adjacent pairs of fins. The fins of each adjacent pair are separated by a distance that is sufficiently small to allow moistening fluid to be held between the fins of the adjacent pair of fins by surface tension of the moistening fluid. The flap moistening device further includes first and second bearing mechanisms respectively mounted on opposed walls of the reservoir to rotationally support the fluid transfer member in a horizontal orientation in the reservoir. The flap moistening device also includes a drive mechanism coupled to the fluid transfer member to rotationally drive the fluid transfer member, and a control mechanism operatively connected to the drive mechanism to select a rotational rate at which the drive mechanism rotationally drives the fluid transfer member. As the fluid transfer member rotates, it raises moistening fluid above the substantially constant level of the moistening fluid in the reservoir to transfer the moistening fluid to the first brush. Also, the first brush pivots between an upper position in which the envelope flap is interposed between the first brush and the fluid transfer member and a lower position in which the first brush is combed by the fins of the fluid transfer member.

The flap moistening device may further include a second brush mounted on a bottom wall of the reservoir and positioned to be combed by the fins of the fluid transfer member as the fluid transfer member rotates. The fluid transfer member may be oriented transversely to a direction in which the envelope is transported by the transport mechanism.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

An envelope flap moistening device of the present invention includes a rotary moistening fluid transfer member to transfer moistening fluid from a fluid reservoir to an applicator. The fluid transfer member includes opposed surfaces between which moistening fluid is held by surface tension to allow the moistening fluid to be raised from the reservoir to the applicator. With such a fluid transfer member, it may be practical to transfer a greater volume of moistening fluid per unit time from reservoir to applicator than could be accomplished with a wick as in conventional flap moistening devices. Furthermore, the envelope flap moistening device of the present invention may include a control mechanism that can selectively change the rotational rate at which the fluid transfer member is rotationally driven to adapt to varying mail piece processing rates and/or varying envelope sizes and/or varying environmental conditions. Thus the envelope flap moistening device of the present invention permits more precisely controlled wetting of the applicator to in turn allow for more precisely controlled and more satisfactory moistening of envelope flaps. Accordingly, more reliable sealing of envelope flaps may be accomplished.

Figure 1:
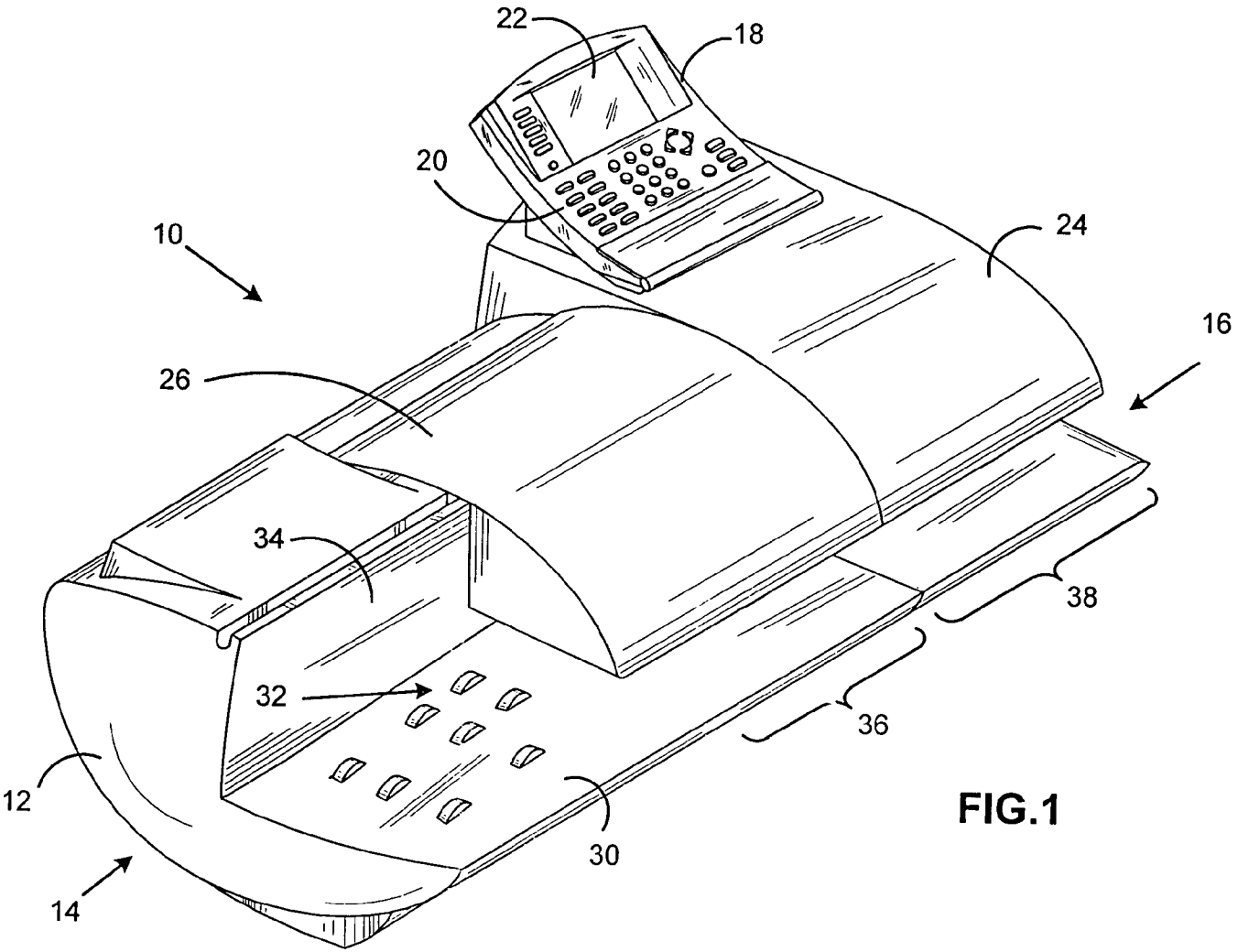
FIG. 1 is a perspective view of a typical mailing machine constructed and arranged in accordance with the principles of the present invention.

Referring now to the drawings, and particularly to FIG. 1, the reference numeral 10 indicates generally a typical mailing machine which incorporates the principles of the present invention. The mailing machine 10 includes a base unit generally designated by the reference numeral 12. The base unit 12 has an envelope infeed end, generally designated by the reference numeral 14 and an envelope outfeed end, designated generally by the reference numeral 16. A control unit 18 is mounted on the base unit 12, and includes one or more input/output devices, such as, for example, a keyboard 20 and a display device 22.

Cover members 24, 26 are pivotally mounted on the base 12 and are moveable between a closed position shown in FIG. 1 and an open position (not shown). In the open position of the cover members 24, 26, various operating components and parts are exposed for service and/or repair as needed. A mail piece transport mechanism which is not visible in FIG. 1 is housed under the cover members 24, 26. An envelope flap moistening device in accordance with principles of the present invention is described below and is housed under the cover member 26.

The base unit 12 further includes a generally horizontal feed deck 30 which extends substantially from the infeed end 14 to the outfeed end 16. A plurality of nudger rollers 32 are suitably mounted under the feed deck 30 and project upwardly through openings in the feed deck so that the rollers 32 can exert a forward feeding force on a succession of mail pieces placed in the infeed end 14. A vertical wall 34 defines a mail piece stacking location from which the mail pieces are fed by the nudger rollers 32 along the feed deck 30 and into the transport mechanism referred to above. The transport mechanism transports the mail pieces through one or more modules, such as, for example, a separator module and moistening/sealing module including an envelope flap moistening device in accordance with principles of the invention. Each of these modules is located generally in the area indicated by reference numeral 36. The mail pieces are then passed to a metering/printing module located generally in the area indicated by reference numeral 38.

Figure 2:
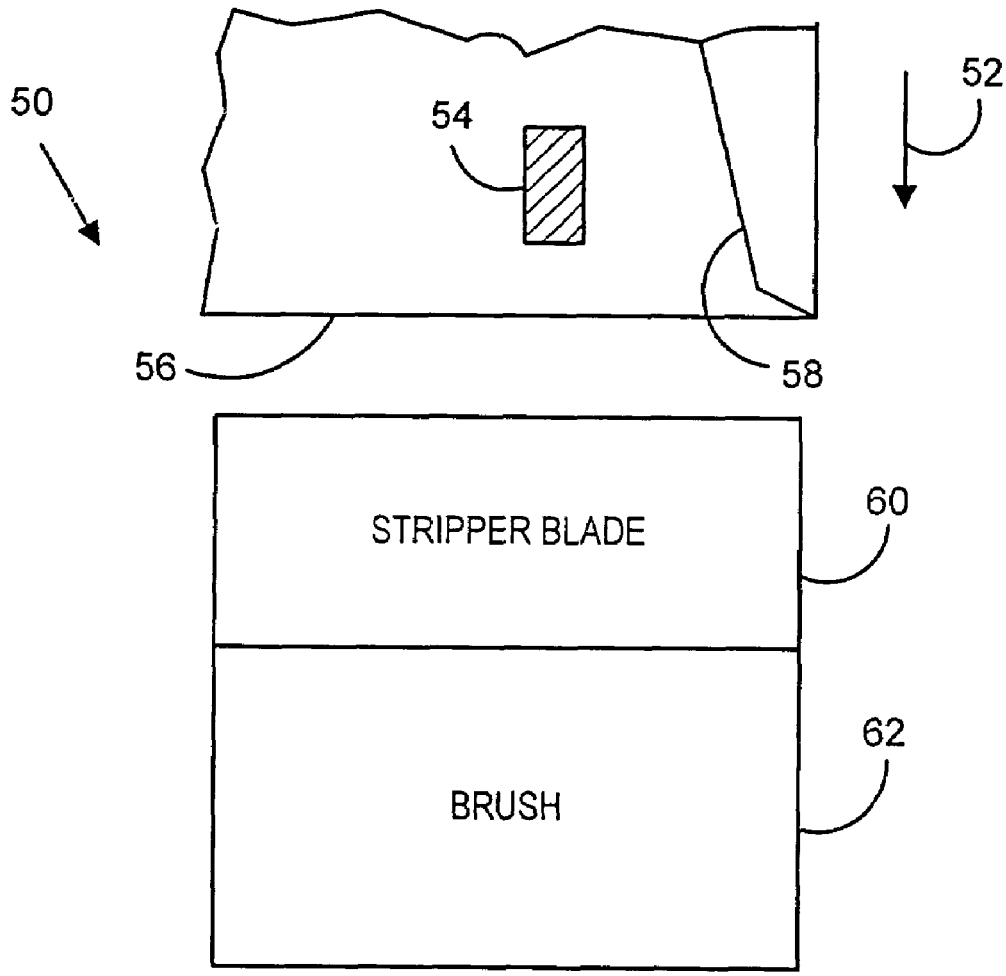
FIG. 2 is a schematic partial inverted plan view of an envelope flap moistening device that is part of the mailing machine of FIG. 1.

FIG. 2 is a schematic partial inverted plan view of an envelope flap moistening device 50 in accordance with the present invention. The envelope flap moistening device 50 is positioned along an envelope feed path represented by an arrow 52. The envelope feed path 52 may be defined in part by the feed deck 30 shown in FIG. 1, which is not separately indicated in FIG. 2. Also serving to define the envelope feed path are one or more conventional envelope transport elements (of which one is schematically represented at 54 in FIG. 2). In accordance with conventional practices, the envelope transport elements may include either or both of an envelope drive roller forming a drive nip with a pressure roller, and a drive belt mounted in opposition to a plurality of pressure rollers.

Also partially shown in FIG. 2 is an envelope 56 having a flap 58 that is to be moistened.

The envelope flap moistening device 50 includes a stripper blade 60 which may be provided in accordance with conventional practices. As is familiar to those who are skilled in the art, the function of the stripper blade 60 is to separate the envelope flap 58 sufficiently from the body of the envelope 56 to allow moistening fluid to be applied to a gummed region (not separately shown) on an inner surface of the envelope flap.

The envelope flap moistening device 50 further includes an applicator brush 62 positioned immediately downstream along the envelope feed path from stripper blade 60. The applicator brush 62 may also be provided in accordance with conventional practices. As is conventional, the function of the applicator brush 62 is to apply moistening fluid to the envelope flap.

Figure 3:
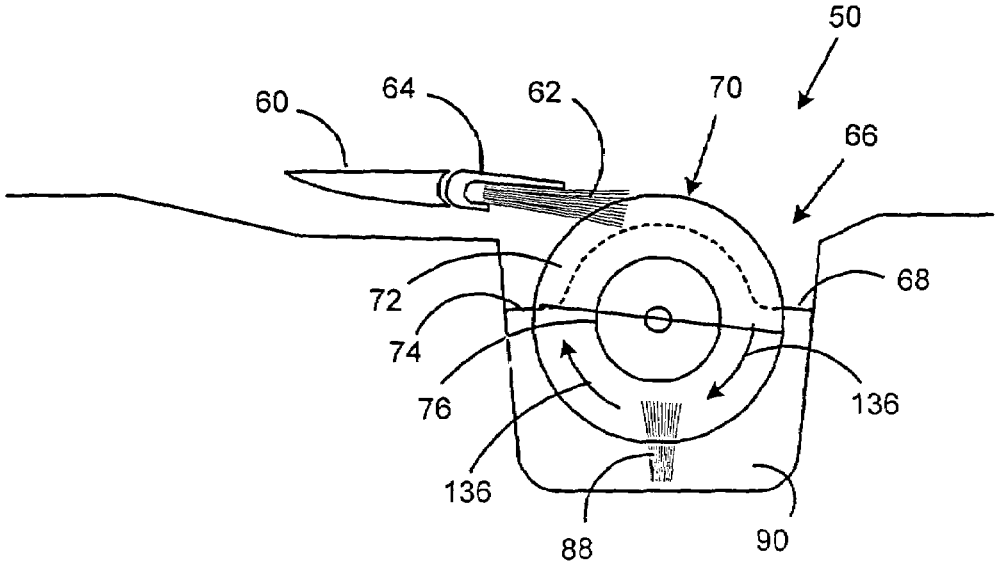
FIG. 3 is a schematic side view of an envelope flap moistening device of the present invention, showing an applicator brush positioned to allow transfer of moistening fluid to the applicator brush.
Figure 4:
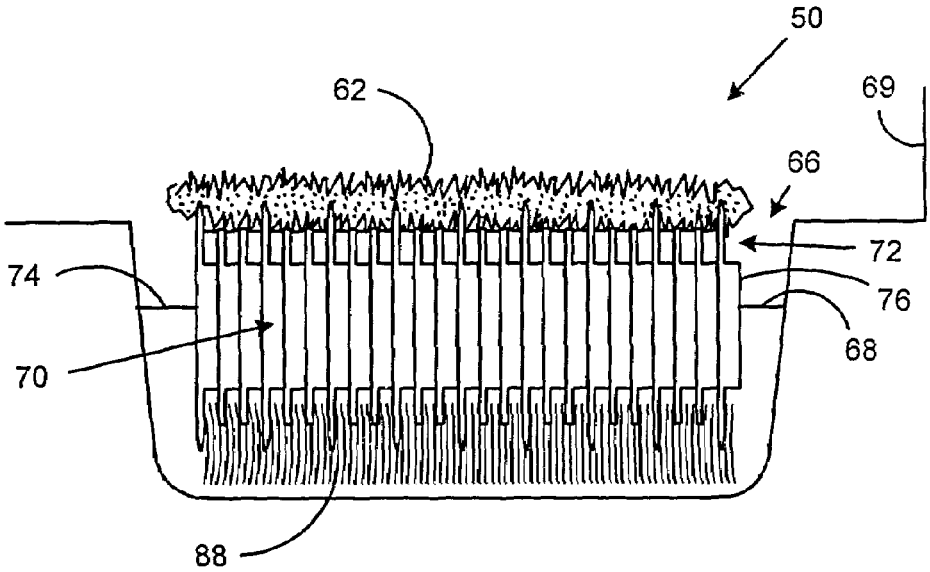
FIG. 4 is a schematic front view of an envelope flap moistening device of the present invnetion, showing the applicator brush positioned to allow transfer of moistening fluid to the applicator brush.
Figure 5:
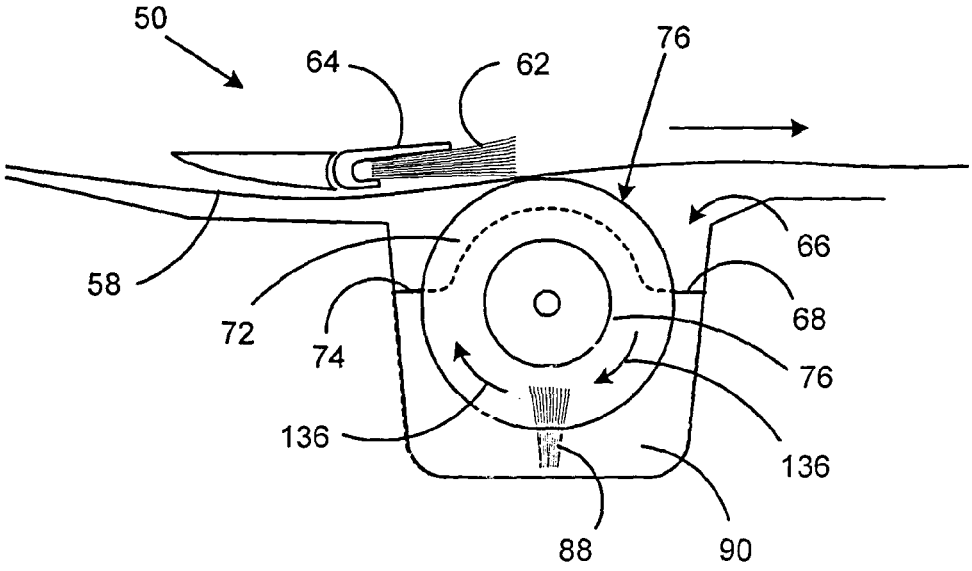
FIG. 5 is a view similar to FIG. 3, showing the applicator brush positioned to transfer moistening fluid to the flap of an envelope.
Figure 6:
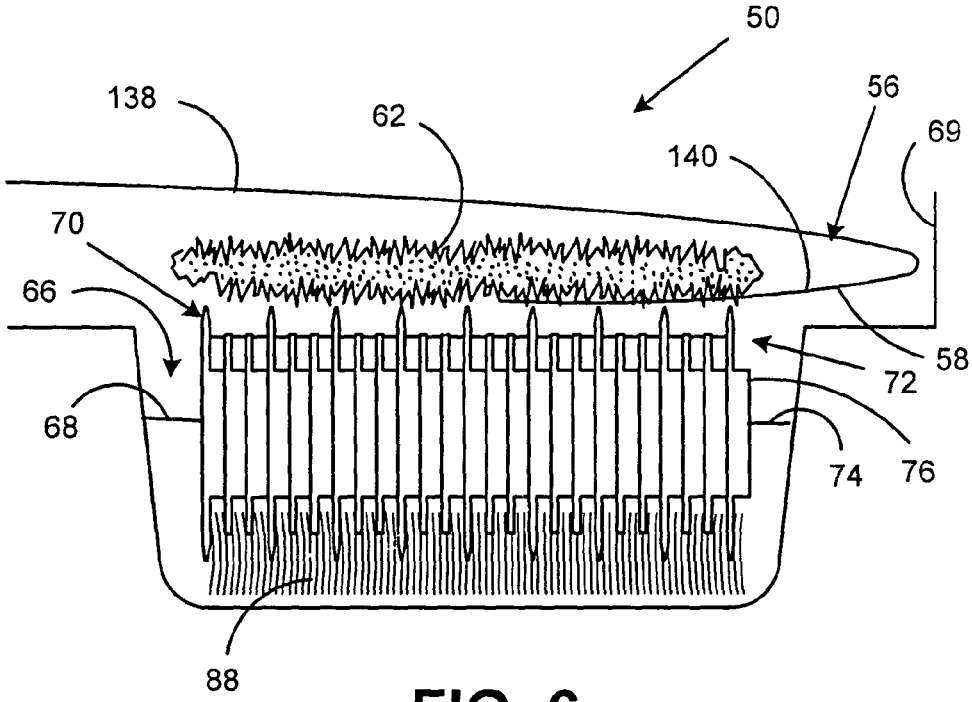
FIG. 6 is a view similar to FIG. 4, showing the applicator brush positioned to transfer moistening fluid to the flap of the envelope.

There will now be described, with initial reference to FIGS. 3–6, other features of the envelope flap moistening device 50, including a novel arrangement for transferring moistening fluid to the applicator brush 62. FIG. 3 is a schematic side view of the envelope flap moistening device 50, showing the applicator brush 62 positioned to allow transfer of moistening fluid to the applicator brush 62. FIG. 4 is a schematic front view of the envelope flap moistening device 50, showing the applicator brush 62 positioned to allow transfer of moistening fluid to the applicator brush 62. FIG. 5 is a view similar to FIG. 3, showing the applicator brush 62 positioned to transfer moistening fluid to the envelope flap 58. FIG. 6 is a view similar to FIG. 4, showing the applicator brush 62 positioned to transfer moistening fluid to the envelope flap 58.

As schematically illustrated in FIGS. 3 and 5, the applicator brush 62 is mounted in a pivoting brush mount 64, by which the applicator brush 62 is allowed to pivot between the position shown in FIGS. 3 and 4 (sometimes referred to as the "lower position" of the applicator brush) and the position shown in FIGS. 5 and 6 (sometimes referred to as the "upper position" of the applicator brush). The brush mount 64 and the arrangement (not shown) by which the brush mount is pivotally mounted on the mailing machine may be provided in accordance with conventional practices.

The envelope flap moistening device 50 also includes a reservoir 66 which holds moistening fluid 68. The reservoir is at least partially adjacent to a registration wall 69 against which tops of envelopes may be registered in accordance with conventional practices. It will be noted that the applicator brush 62 is mounted above the reservoir 66. The envelope flap moistening device 50 further includes a moistening fluid transfer member 70 which, as conceptually illustrated in FIGS. 3–6, is mounted for rotation about a horizontal axis within the reservoir 66. (Some details of a mounting arrangement for the fluid transfer member will be described below in connection with FIG. 9.) As will be seen, a function of the fluid transfer member 70 is to transfer moistening fluid 68 from the reservoir 66 to the applicator brush 62. The transfer of moistening fluid from the reservoir 66 to the applicator brush 62 is accomplished with rotation of the fluid transfer member 70. In particular, the fluid transfer member 70 is configured so that it picks up and raises moistening fluid 68 from the reservoir 68 by action of surface tension in the moistening fluid that causes the moistening fluid to be held by a fluid transport portion 72 of the fluid transfer member as the fluid transport portion 72 of the fluid transfer member 70 rotates up from the surface 74 of the moistening fluid 68.

Details of one embodiment of the fluid transfer member 70 will now be described with reference to FIG. 7, which is an enlarged sectional view of the fluid transfer member. The fluid transfer member 70 may include a generally cylindrical hub portion 76 on which the fluid transport portion 72 is carried. The fluid transport portion may include a plurality of pairs of opposed surfaces (e.g., surfaces 78, 80 shown in FIG. 7) which are substantially vertical and with the two surfaces of the pair of surfaces being separated by a distance d that is sufficiently small to allow moistening fluid (not shown in FIG. 7) to be held between the two surfaces of the pair of surfaces by surface tension of the moistening fluid. The fluid transfer member 70 thus may include generally annular ribs which extend radially outwardly from the hub portion 76, including, in the particular embodiment shown, first fins 82 having a first diameter $D_1$ and second fins 84 having a second diameter $D_2$ that is less than $D_1$, with the opposed surfaces to carry the moistening fluid being formed as facing surfaces of adjacent pairs of the fins 82, 84. The opposed surfaces (e.g., 78, 80) may be substantially annular and the fins 82, 84 may be substantially annular. Each of the larger fins 82 may, in some embodiments, terminate in a knife edge 86. It should be understood that "knife edge" may refer to an edge of a fin 82 that is substantially narrower than the region of the fin at which moistening fluid is carried. As will be seen, the purpose of the knife edges 86 is to minimize contact between the fluid transfer member 70 and an envelope flap 58 which passes over the fluid transfer member, and to hold the outside of the envelope flap 58 away from the moistening fluid carried by the fluid transfer member 70.

In some embodiments $D_1$ may be about 25 to 30 mm (with the reservoir having a depth of about 35 to 40 mm). $D_2$ may be around 20 to 25 mm. In some embodiments the pitch of the fins 82, 84 along the length of the hub portion 76 may be on the order of about 1.5 to 3 mm (e.g., about 2 mm), and the thickness of the fins may be about 1 mm at or near the hub portion 76 so that the distance d between opposed surfaces may be about 1 mm. Alternatively these dimensions may be varied within appropriate ranges to allow the fluid transfer member 70 to transfer moistening fluid to the applicator brush.

Figure 7:
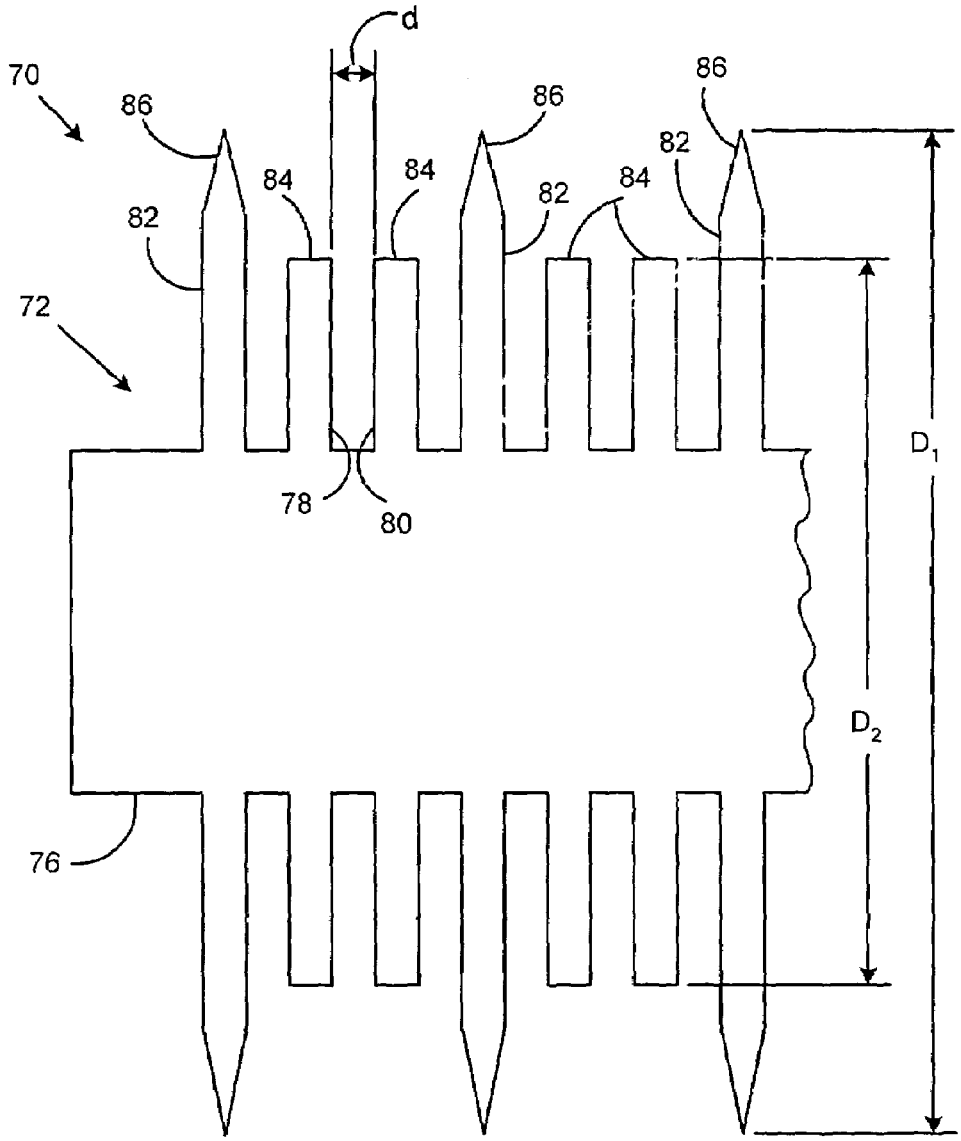
FIG. 7 is an enlarged, partial sectional view of one embodiment of a fluid transfer member that is part of the envelope moistening device.

In the embodiment shown in FIG. 7, the smaller fins 84 are interspersed with the larger fins 82, with two smaller fins 84 between every two adjacent larger fins 82. However, in other embodiments, there may be only one, or three or more smaller fins 84 between every two adjacent larger fins 82.

Figure 8:
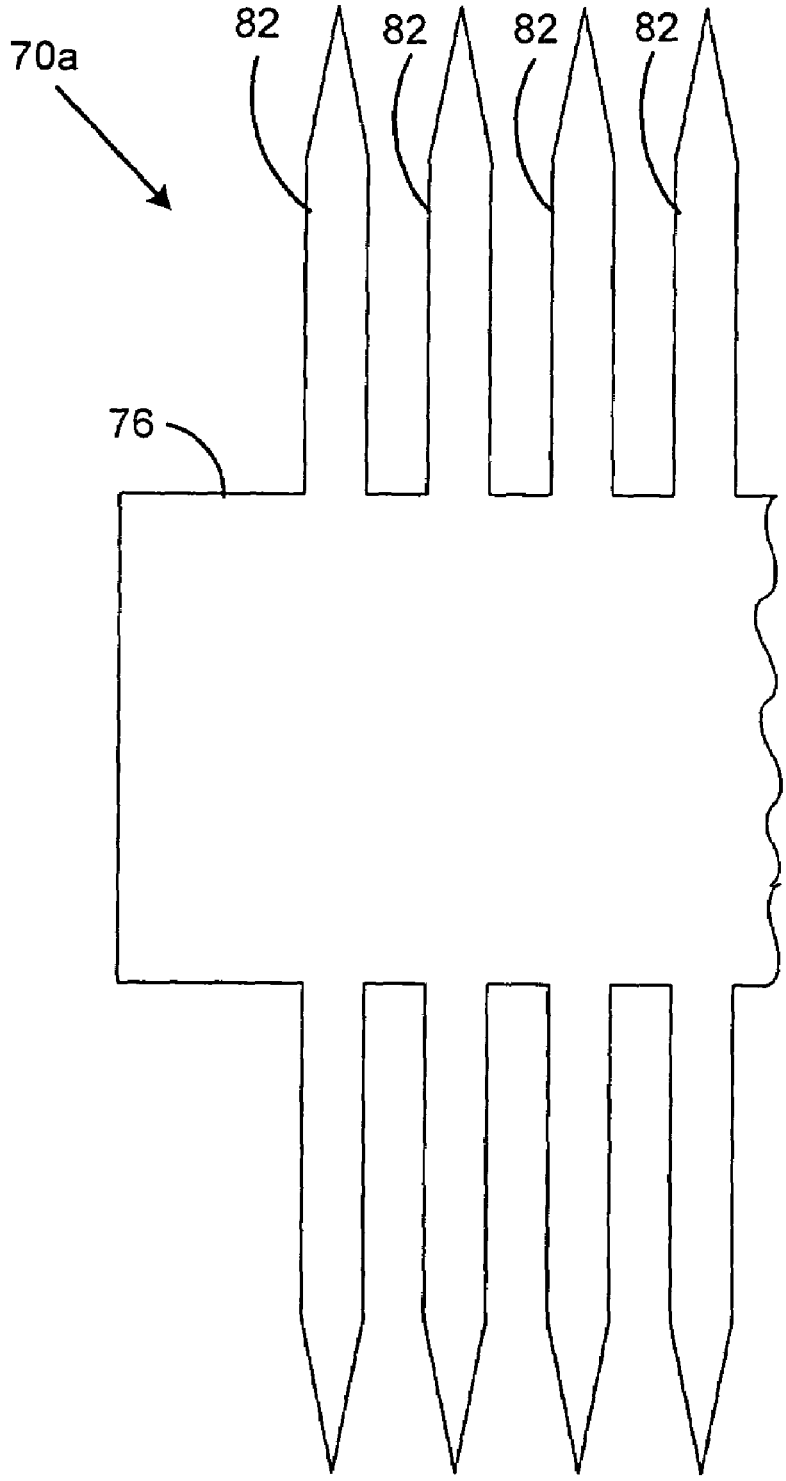
FIG. 8 is a view similar to FIG. 7 of another embodiment of a fluid transfer member.

In still other embodiments, as illustrated in FIG. 8, an alternative fluid transfer member 70*a* may be provided in which the smaller fins 84 of the transfer member 70 of FIG. 7 are replaced with larger, knife-edged fins 82. Thus, in the embodiment of FIG. 8, all of the fins are substantially the same size and are knife-edged.

Referring again to FIGS. 3–6, the flap moistening device 50 may also include a cleaning brush 88 that is mounted on a bottom wall 90 of the reservoir 66 and is positioned such that the cleaning brush 88 is combed by the fins 82, 84 of the fluid transfer member 70 as the fluid transfer member 70 rotates. The function of the cleaning brush 88 is to provide cleaning of the fluid transfer member 70.

Figure 9:
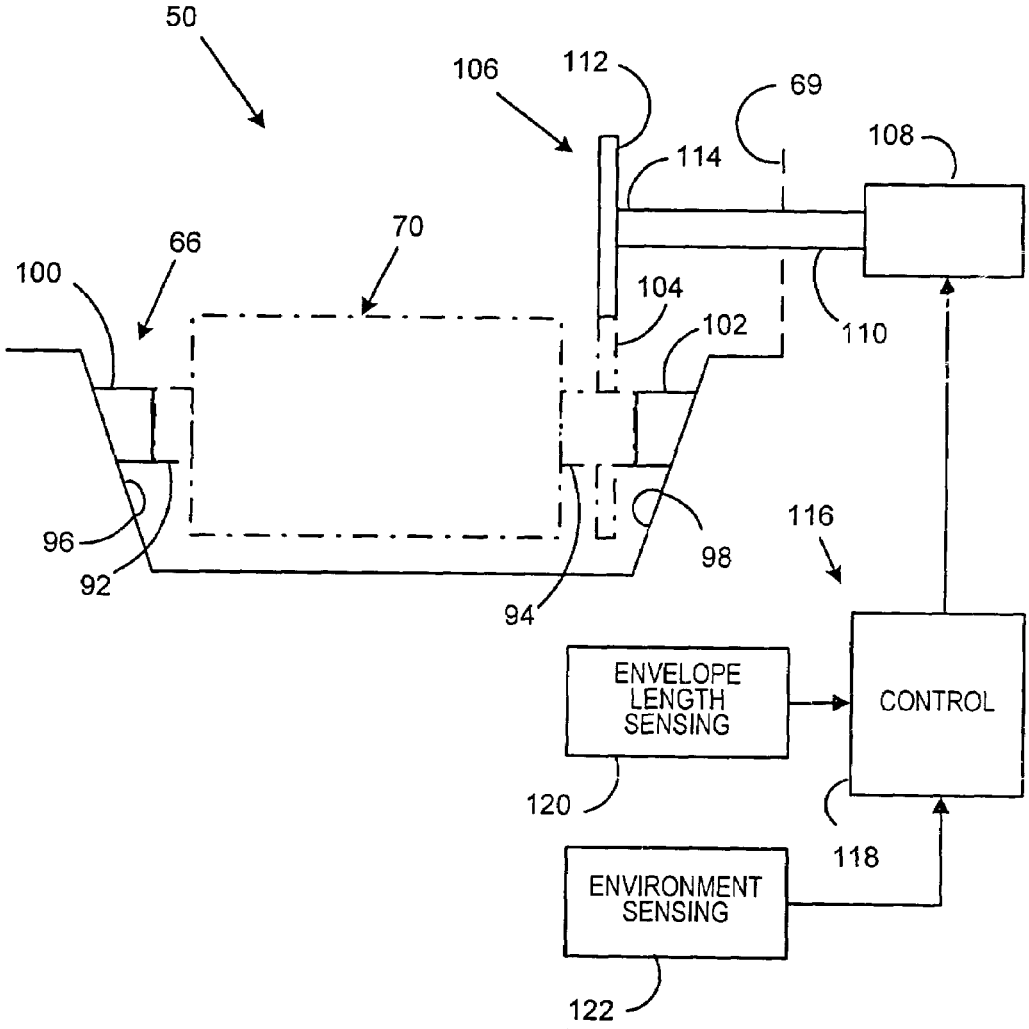
FIG. 9 is a schematic front view showing a mounting, driving and control arrangement for a fluid transfer member of the envelope flap moistening device.

There will now be described, with reference to FIG. 9, arrangements for rotationally driving, and for the controlling the driving of, the fluid transfer member 70 (shown with dash-dot lines in FIG. 9). As seen from FIG. 9, the fluid transfer member 70 includes a left hub-extension 92 and a right hub-extension 94, both of which may be integrally formed with, and extend axially outwardly from opposite ends of, the hub portion 76 (FIGS. 3–6, not shown separately in FIG. 9) of the fluid transfer member 70. The right hub-extension 94 may be longer than the left hub-extension 92.

The reservoir 66 has a left side wall 96 and a right side wall 98, the two side walls 96, 98 being opposed to each other. A first bearing 100 is mounted on the left side wall 96 and a second bearing 102 is mounted on the right side wall 98. The bearings 100, 102 are positioned and configured so as to rotationally support the fluid transfer member 70 therebetween via the hub-extensions 92, 94, respectively. A driven gear 104 may be integrally formed with the right hub-extension 94.

The flap moistening device 50 further includes a transfer member driving system 106. The driving system 106 includes a motor 108, a gearshaft 110 coupled to the motor 108 for being rotationally driven by the motor 108, and a driving gear 112 at an end 114 of the gearshaft 110. It will be noted that the gearshaft 110 may extend through the registration wall 69 (shown in phantom in FIG. 9). The driving gear 112 has teeth (not separately shown) that are meshed with teeth (not separately shown) of the driven gear 104 of the fluid transfer member 70. Thus the motor 108 is coupled to the fluid transfer member 70 via the gearshaft 110 and the gears 112, 104 so as to allow the motor 108 to rotationally drive the fluid transfer member 70.

The motor 108 may be, in some embodiments, a variable-speed motor, and the flap moistening device 50 may further include a control system 116 that is operatively connected to the motor 108 to control the speed of the motor 108 and thereby to select among two or more different rotational rates at which the fluid transfer member 70 may be rotationally driven by the motor 108. In particular, the control system 116 may include a control circuit 118 (including, for example, a suitably programmed microprocessor or microcontroller) that is operatively coupled to the motor 108. The control system 116 may also include, in some embodiments, one or more sensors, including, for example, an envelope length sensor 120 and one or more sensors 122 for sensing environmental conditions. The sensors 120, 122 may be operatively coupled to the control circuit 118. The sensors 122 may include, for example, one or more of a temperature sensor, a humidity sensor, an air pressure sensor, and an altimeter. The sensor 120 may include, for example, a through-beam sensor positioned adjacent to the envelope feed path to detect a leading edge and a trailing edge of an envelope fed along the envelope feed path to detect the length of the envelope. In addition to or in place of the sensors 120, 122, the control system 116 may include a user interface (which may be included as part of the control unit 18 (FIG. 1)) to allow an operator of the mailing machine 10 to select a rotational rate for driving the fluid transfer member 70 and/or to input data which may be a basis for the control circuit 118 to select a rotational rate for driving the fluid transfer member 70. Such data input by the operator may include, for example, a rate at which the mailing machine is to be operated. The rate at which the mailing machine is to be operated may correspond, for example to a rate at which the envelopes are to be transported by the transport mechanism of the mailing machine. This transport rate may be measured in a number of ways, including one or more of: (a) a pitch between envelopes in a stream of envelopes transported by the transport mechanism, (b) a gap (distance) between adjacent envelopes in the stream of envelopes, and (c) a velocity at which the transport mechanism transports the envelopes.

Figure 10:
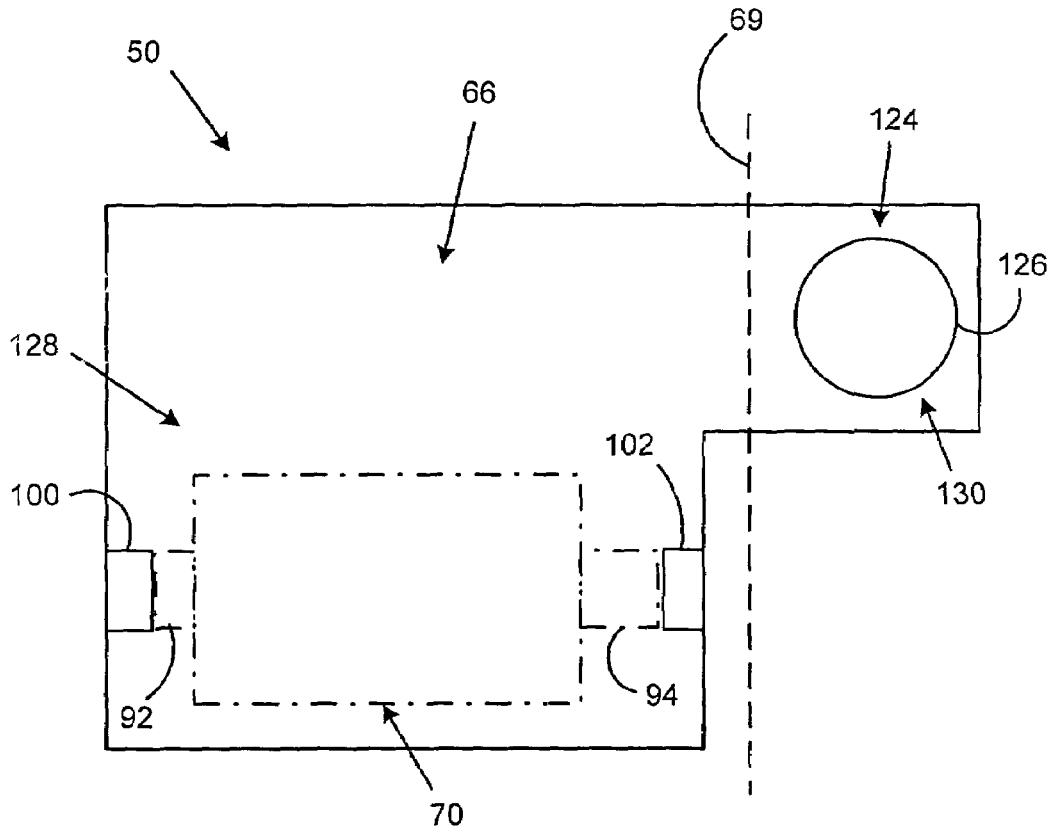
FIG. 10 is a partial schematic plan view of the envelope flap moistening device.
Figure 11:
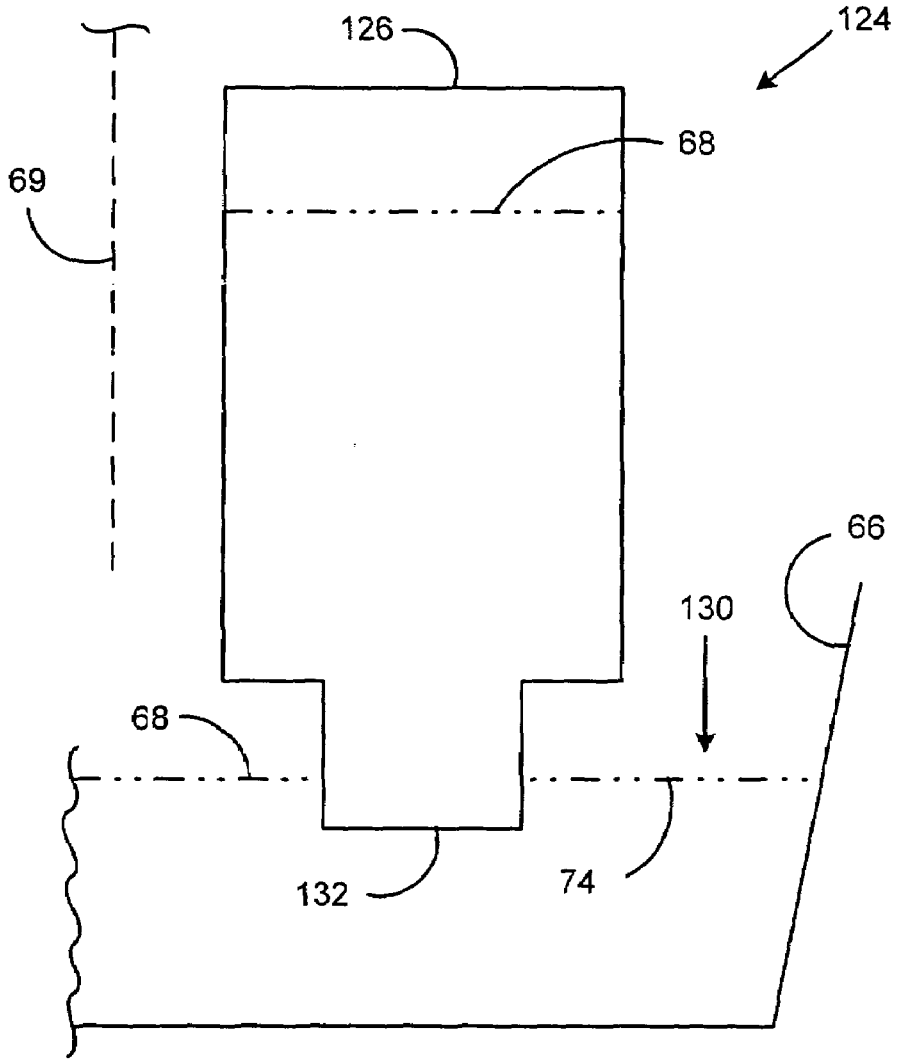
FIG. 11 is a partial schematic vertical cross-sectional view showing an arrangement for replenishing moistening fluid in a fluid reservoir of the envelope flap moistening device.

An arrangement for replenishing the moistening fluid in the reservoir 66, as provided in some embodiments, will now be described with reference to FIGS. 10 and 11. FIG. 10 is a partial schematic plan view of the envelope flap moistening device 50, showing the full horizontal extent of the reservoir 66 as provided according to some embodiments. FIG. 11 is a partial schematic vertical cross-sectional view showing some details of a fluid replenishment system 124 as provided in some embodiments for the envelope flap moistening device 50. The fluid replenishment system 124 may comprise, for example, a conventional "chicken feeder" replenishment system, including a bottle 126 mounted (by conventional mounting structure which is not shown) in an inverted orientation at an extension 128 of the reservoir 66, the extension 130 being located behind the registration wall 69 and being in fluid communication with a main portion 128 of the reservoir which is to the left of the registration wall 69. The fluid transfer member 70 is mounted within the main portion 130 of the reservoir 66.

The bottle 126 is positioned behind the registration wall 69 so as not to impede the envelope feed path, which is to the left of the registration wall 69, as seen in FIG. 10. The bottle 126 contains moistening fluid 68. Referring to FIG. 11, the level of the moistening fluid 68 in the reservoir 66 is normally such that the rim 132 of the bottle 126 is below the surface 74 of the moistening fluid in the reservoir. However, when enough moistening fluid is withdrawn from the reservoir 66 by the fluid transfer member 70 to lower the surface of the moistening fluid 68 in the reservoir 66 below the rim 132 of the bottle 126, air may then enter the bottle 126, thereby allowing moistening fluid to flow out of the bottle 126 into the reservoir 66 until the level of the moistening fluid in the reservoir is again above the rim 132 of the bottle 126. Thus the fluid replenishment system including the bottle 132 functions to maintain a substantially constant level of the moistening fluid in the reservoir.

Operation of the mailing machine 10, and in particular operation of the envelope flap moistening device 50, will now be described. When no envelope is present at the envelope flap moistening device 50, the applicator brush 62 is in its lower position shown in FIGS. 3 and 4, with the applicator brush 62 in contact with the fins 82, 84 (FIG. 7 or FIG. 8) of the fluid transfer member 70 and with the applicator brush 62 also in contact with moistening fluid 68 that has been raised from the reservoir 66 between the fins of the fluid transfer member 70, so that moistening fluid is transferred from the fluid transfer member 70 to the applicator brush 62. The fluid transfer member 70 may be continuously rotationally driven by the driving system 106 (FIG. 9) so that the fluid transfer member rotates, e.g., in the direction indicated in FIG. 3 by arrows 136. Alternatively, the fluid transfer member 70 may be only intermittently driven, and/or may be driven only in conjunction with feeding of envelopes through the envelope flap moistening device 50. As the fluid transfer member 70 rotates, the fluid transfer member raises the moistening fluid 68 from the reservoir 66 above the prevailing level of the moistening fluid in the reservoir 66, and the fins 82, 84 comb the applicator brush 62. Rotation of the fluid transfer member 70 also causes the fins 82, 84 to comb the cleaning brush 88 (FIG. 4), resulting in cleaning of the fluid transfer member by the cleaning brush.

Referring to FIG. 1, a sequence of envelopes (not shown in FIG. 1) may be fed flap side down from the infeed end 14 of the mailing machine 10 along the envelope feed path 52 (FIG. 2) and transported by one or more envelope transport elements 54 toward the envelope flap moistening device 50. The flap 58 of envelope 56 (FIGS. 2, 5, 6) encounters the stripper blade 60 which separates the envelope flap 58 from the body 138 (FIG. 6) of the envelope. As the envelope is driven through the flap moistening device 50, the flap 58 lifts the applicator brush 62, causing the applicator brush 62 to pivot upwardly from the lower position shown in FIGS. 3 and 4 to the upper position shown in FIGS. 5 and 6. The applicator brush is in contact with the inner (upper), gummed surface 140 of the envelope flap 58 to transfer moistening fluid to the gummed surface 140 along the length of the flap 58 as the envelope passes through the flap moistening device. Meanwhile, the envelope flap 58 is interposed between the applicator brush 62 and the fluid transfer member 70 with the knife edges 86 (FIG. 7) of the fins 82 of the fluid transfer member 70 in contact with the outer (lower) surface of the envelope flap 58 (FIG. 6) to keep the envelope flap away from the fluid transport portion 72 of the fluid transfer member 70 and to minimize or eliminate transfer of moistening fluid to the outer surface of the envelope flap.

As the envelope exits from the flap moistening device, the brush 62 pivots downwardly under the force of gravity from the upper position of FIGS. 5 and 6 to the lower position of FIGS. 3 and 4.

From the flap moistening device, the envelope may next be fed through a sealing nip (not shown) which may be provided in accordance with conventional practices to seal the envelope. The envelope may then be transported through the balance of the area 36 (FIG. 1), and through area 38 for printing, and then may be ejected from the outfeed end 16 of the mailing machine 10.

In some embodiments, as noted above, the motor 108 (FIG. 9) of the driving system 106 may be a variable speed motor, and the control circuit 118 may select a rotational rate at which the driving system 106 rotationally drives the fluid transfer member 70 from among a plurality of rotational rates, based on one or more inputs and/or factors. For example, a rotational rate selected by the control circuit 118 may be based at least in part on a transport rate at which a stream of envelopes is transported through the mailing machine 10. That is, in some embodiments, the fluid transfer member may be rotated faster, to transport more moistening fluid to the applicator brush, at times when faster envelope transport rates are in effect for the mailing machine.

In addition, or alternatively, one or more sensors 122 may detect one or more environmental conditions (e.g., humidity, temperature, altitude and/or air pressure) and the control circuit 118 may select a rotational rate for the fluid transfer member based on one or more signals from the sensor or sensors 122. For example, the fluid transfer member may be rotated faster to transfer more moistening fluid to the applicator brush at times when the humidity is relatively low.

In addition, or alternatively, an envelope length sensor 120 may detect a length of one or more envelopes fed through the mailing machine, and the control circuit 118 may select a rotational rate for the fluid transfer member based on one or more signals from the sensor 120. For example, the fluid transfer member may be rotated faster to transfer more moistening fluid to the applicator brush when the sensor 120 detects that the envelope or envelopes fed through the mailing machine are relatively long and therefore may be more likely to dry out the applicator brush.

In addition, or alternatively, the operator of the mailing machine may provide input to the control circuit 118 to cause the control circuit 118 to increase or decrease the rotational rate of the fluid transfer member. For example, the operator may observe that the envelope flaps are being excessively or inadequately moistened, and may accordingly provide input to slow down or speed up the rotational rate of the fluid transfer member to decrease or increase the amount of moistening fluid transferred to the applicator brush by the fluid transfer member.

In the envelope flap moistening device as disclosed herein, with a rotary member that actively transfers moistening fluid from a reservoir to an applicator brush, it may be practical to provide fluid transfer in greater volume than in moistening devices in which the applicator is fed by wick from the reservoir. As a result, adequate moistening of envelope flaps may be achieved even in circumstances that have heretofore required greater fluid transfer than provided by wicks. In addition, it may be possible to control the amount of fluid transferred to the applicator to adapt the amount of fluid transferred to various operating and/or environmental conditions, thereby optimizing the operation of the flap moistening device.

A number of embodiments of the present invention have been described. Nevertheless, it will be understood that various modifications may be made without departing from the spirit and scope of the invention. For example, the "chicken feeder" fluid replenishment system may be replaced with another type of replenishment system or dispensed with entirely. Furthermore, the rate of rotation of the fluid transfer member may be constant rather than variable, and the control circuit may be omitted. Also, one or more of the sensors connected to the control circuit may be omitted. In addition, the driving system 106 may be modified in a number of respects. The cleaning brush may be omitted. Accordingly, other embodiments are within the scope of the following claims.

What is claimed is:

1. A device for moistening an envelope flap comprising:

a reservoir for holding a moistening fluid;

an applicator including a first brush mounted above the reservoir for applying the moistening fluid to the envelope flap; and a fluid transfer member, mounted for rotation about a horizontal axis such that a portion of the fluid transfer member is submerged in the moistening fluid, the fluid transfer member including a substantially cylindrical hub portion and a plurality of generally annular fins extending radially outward from the hub portion, the plurality of fins include a first plurality of fins having a first diameter and terminated in a knife edge and a second plurality of fins interspersed with the fins of the first plurality and having a second diameter that is less than the first diameter, the plurality of fins being separated by a distance that is sufficiently small to allow moistening fluid to be held between the fins by surface tension of the fluid to raise the moistening fluid above a surface of the fluid in the reservoir as the transfer member is rotated, the fluid transfer member transferring moistening fluid from the reservoir to the applicator while the transfer member rotates.

2. The device according to claim 1, further comprising a second brush mounted in the reservoir and positioned to be combed by the fins of the transfer member as the transfer member rotates.

3. The device according to claim 1, wherein the first brush is mounted so as to pivot between an upper position in which the envelope flap is interposed between the first brush and the transfer member and a lower position in which the first brush is combed by the transfer member.

4. The device according to claim 1, further comprising:

drive means coupled to the transfer member for rotationally driving the transfer member; and control means operatively connected to the drive means for selecting a rotational rate at which the drive means rotationally drives the transfer member.

5. The device according to claim 4, wherein the control means selects the rotational rate at which the drive means rotationally drives the transfer member based at least in part on at least one of (a) a rate at which envelopes are transported past the applicator, and (b) a size of at least one envelope transported or to be transported past the applicator.

6. The device according to claim 4, further comprising:

sensing means, operatively connected to the control means, for sensing at least one environmental condition;

wherein the control means selects the rotational rate at which the drive means rotationally drives the transfer member based at least in part on a signal output from the sensing means.

7. The device according to claim 4, further comprising:

sensing means, operatively connected to the control means, for detecting a length of an envelope transported past the applicator;

wherein the control means selects the rotational rate at which the drive means rotationally drives the transfer member based at least in part on a signal output from the sensing means.

8. The device according to claim 1, further comprising:

means for defining an envelope transport path along which envelopes are transported, the applicator being positioned adjacent the envelope transport path.

9. A mailing machine comprising:

transport means for transporting an envelope along an envelope feed path;

a reservoir positioned below the envelope feed path and holding a moistening fluid;

means for replenishing the moistening fluid in the reservoir to maintain a substantially constant level of the moistening fluid in the reservoir;

a first brush pivotally mounted along the envelope feed path for transferring moistening fluid to a flap of an envelope transported along the envelope feed path;

a fluid transfer member associated with the reservoir, the fluid transfer member including a substantially cylindrical hub portion and a plurality of generally annular fins extending radially outwardly from the hub portion, the plurality of fins including a first plurality of fins having a first diameter and terminated in a knife edge and a second plurality of fins interspersed with the fins of the first plurality and having a second diameter that is less than the first diameter, the plurality of fins being separated by a distance that is sufficiently small to allow moistening fluid to be held between the fins by surface tension of the fluid, the fluid transfer member being mounted such that at least a portion of the plurality of generally annular fins are submerged in the moistening fluid in the reservoir;

drive means coupled to the fluid transfer member for rotationally driving the fluid transfer member; and control means operatively connected to the drive means for selecting a rotational rate at which the drive means rotationally drives the transfer member wherein:

as the fluid transfer member rotates, the fluid transfer member raises moistening fluid above the substantially constant level of the moistening fluid in the reservoir to transfer the moistening fluid to the first brush; and the first brush pivots between an upper position in which the envelope flap is interposed between the first brush and the fluid transfer member and a lower position in which the first brush is combed by the fins of the fluid transfer member.

10. The mailing machine according to claim 9, further comprising a second brush mounted on a bottom wail of the reservoir and positioned to be combed by the fins of the fluid transfer member the fluid transfer member rotates.

11. The mailing machine according to claim 9, wherein the fluid transfer member is oriented transversely relative to a direction in which the envelope is transported by the transport means.

* * * * *